United States Patent [19]

Lehman

[11] 4,135,325

[45] Jan. 23, 1979

[54] INFLATABLE FLYING SAUCER TOY

[75] Inventor: James A. Lehman, El Cajon, Calif.

[73] Assignee: Warner-Lehman Corporation, El Cajon, Calif.

[21] Appl. No.: 830,632

[22] Filed: Sep. 6, 1977

[51] Int. Cl.[2] ..... A63H 27/00

[52] U.S. Cl. ..... 46/74 D; 46/87; 9/11 A

[58] Field of Search ..... 46/74 D, 75, 87, 88, 46/89, 90; 9/11 A, 13

[56] References Cited

U.S. PATENT DOCUMENTS

| | | | |
|---|---|---|---|
| 2,562,080 | 7/1951 | Barnes | 9/11 A X |
| 2,804,123 | 8/1957 | Kling | 46/87 X |
| 2,864,201 | 12/1958 | Leise | 46/90 |
| 3,628,206 | 12/1971 | Mecham | 9/11 A |
| 3,959,917 | 6/1976 | Dawson | 46/74 D |

FOREIGN PATENT DOCUMENTS

| | | | |
|---|---|---|---|
| 1603662 | 1971 | France | 46/74 D |

*Primary Examiner*—Russell R. Kinsey
*Assistant Examiner*—Mickey Yu
*Attorney, Agent, or Firm*—Frank D. Gilliam

[57] ABSTRACT

The invention pertains to a hand tossed flying saucer toy being inflatable from a central valve member. The peripheral of the depending lip is substantially circular in cross-section and formed so as to have a memory when the saucer is inflated. The material of construction is such that the inflated saucer is safe for indoor use.

8 Claims, 3 Drawing Figures

FIG. 1
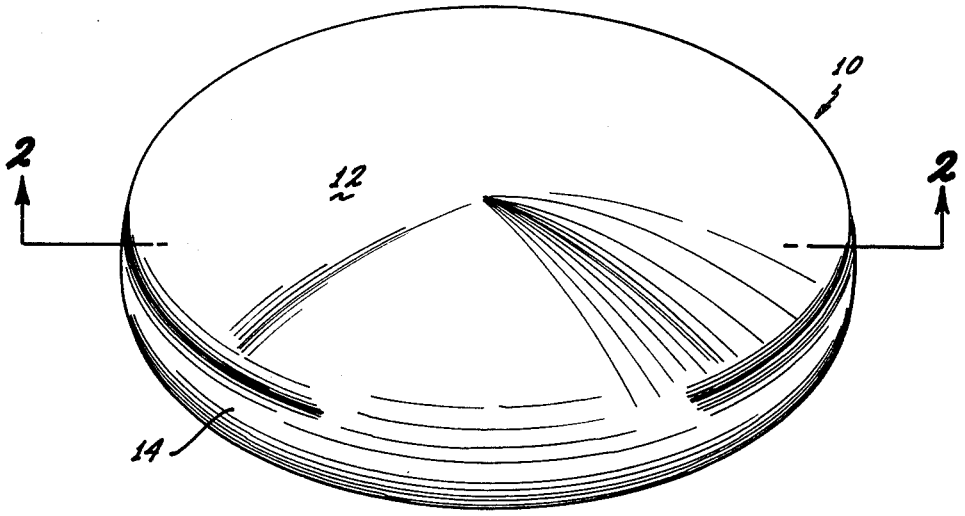
FIG. 2
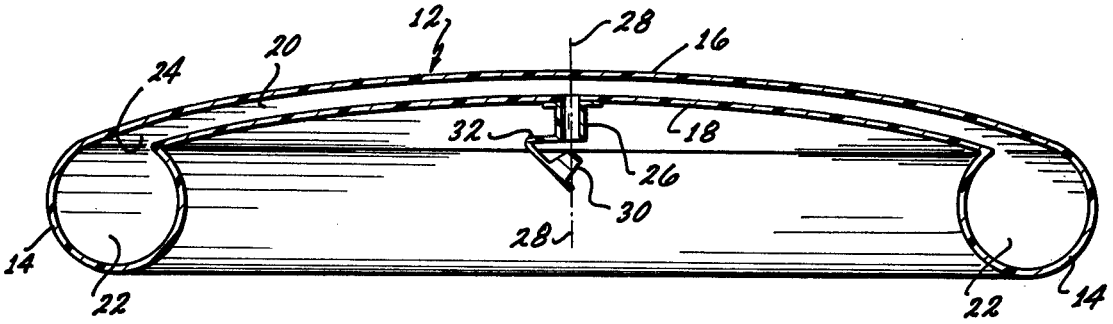
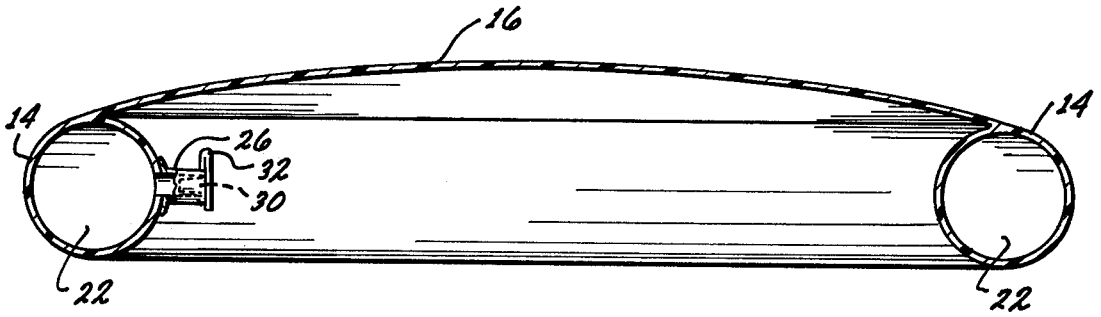
FIG. 3

INFLATABLE FLYING SAUCER TOY

BACKGROUND OF THE INVENTION

Flying saucer toys have become increasingly popular during the past years. A typical saucer is circular with a depending peripheral flange or lip and aside from some slight changes from an accurate cross-section, and the possible addition of a few annular ridges on top, has not changed appreciably in common usage since its inception.

Although the entertainment value of tossing these saucers is undeniable, there are certain deficiencies in the toy as presently designed which it is attempted to remedy by the invention disclosed herein. Because the toy is of a general rigid construction and has a somewhat large physical size, it is both hard to carry on one's person and is not safe for use indoors, where the toy might impact items of a fragile nature causing damage or destruction of the impacted items.

These and various other problems were not satisfactorily resolved until the emergence of the instant invention.

SUMMARY OF THE INVENTION

The instant invention provides the above deficiencies by providing a flying saucer toy that can be folded up and carried on one's person, such as, for example, in a pocket, and selectively inflated when its use is desired. The flying saucer toy is constructed of pliable material having memory characteristics which allow the saucer to return to its prescribed form when inflated with a gas, such as air from the user's mouth, a small low-pressure air pump source, or any gas from any pressurized source. The device includes a simple valve member that can be inserted in its seat when the flying saucer is pressurized to prevent the loss of the pressurized gas and can be selectively released to deflate the flying saucer. The valve member is generally centered on the underside of the central body of the flying saucer to prevent unwanted release of the gas therein. The depending lip of the flying saucer is substantially circular in cross-section with the central portion within the lip area being of substantially uniform width.

The principal object of the invention is to provide a flying saucer toy that can be easily stored on the person and yet be readily available for use.

Another object of the invention is to provide a flying saucer toy that can be used indoors.

The foregoing and various other features and objects of the invention will appear in the course of the description which is rendered below with reference to the accompanying drawings wherein the same reference numerals depict the identical element or part.

BRIEF DESCRIPTION OF THE DRAWINGS

FIG. 1 depicts an elevated perspective view of the inflatable flying saucer toy.

FIG. 2 depicts a cutaway view taken along lines 2—2 of FIG. 1.

FIG. 3 depicts a cutaway view of the device similar to FIG. 2 with a different valve position and a solid upper surface.

The same reference numeral is utilized through the specifications and drawings to indicate the identical element or part.

DETAILED DESCRIPTION OF THE PREFERRED EMBODIMENTS

A flying saucer toy 10 is shown in FIGS. 1 and 2 which is typical of existing flying saucer toys, having a central body portion 12 with depending lip 14. The central body portion when in a flight ready state, as shown, is formed by walls 16, 18 and has a cavity 20 between the walls of substantially uniform separation, i.e., the walls are substantially parallel.

The lip 14 is semi-circular in cross-section with a hollow center portion 22 which interconnects through opening 24 between the walls 16, 18 forming a pressurizable chamber.

On the lower wall 18 is a neck 26 leading into the cavity 20. The neck 26 is shown positioned co-axial with the vertical center line 28 of the central body portion. Attached to the neck 26 is a stopper 30. The stopper is frusto-conic in cross-section tapering inward toward its center line outwardly from its attachment means 32. When the stopper 30 is inserted within the neck 26, a pressure seal is established between the atmosphere and the inner chamber.

Referring now to FIG. 3, unlike the FIG. 2 showing the lip 14 is formed of a circular member having a hollow center 22 while the surfaces 16, 18 are actually one solid piece of pliable material, such as, but not limited to, rubber or the like. The valve member is positioned on the inner side of the lip and operates as hereinbefore described.

The device is generally constructed of a pliable plastic material which has sufficient memory characteristics to return to is molded form when the chamber is in an evacuated state and then re-pressurized. Any other pliable material of construction having the same or similar required characteristics may, of course, be utilized equally as well to practice the invention.

OPERATION OF THE PREFERRED EMBODIMENT

The device is molded in the configuration as shown in the Figures. The neck 26 and stopper attachment 32 may be attached by adhesive means.

To utilize the deflated toy, air or suitable gas under slight pressure is admitted to the chamber through the neck 26. When sufficient gas has been admitted thereto, wherein the desired shape has been established, the stopper 30 is then inserted into the neck 26 where a pressure seal is established thereby maintaining the proper toy configuration. The toy is now ready for use.

When the stopper 30 is withdrawn from the neck 26 and the gas is allowed to escape, the toy will become limp and, if the toy is then squeezed to evacuate all of the gas from the chamber and the stopper 30 is reinserted within the neck, the device is quite small and compact and ready for convenient storage. Because of its now small compact size, the toy can be carried or concealed on the person in a pocket or the like.

Although the invention is quite simple, its advantage is quite significant. One advantage is the fact that it is constructed of pliable material and can readily be used indoors without fear of damage to items of a fragile nature. Another feature of this invention is the fact that the device can be deflated and formed into a very small package and readily carried on the person in a pocket for instant availability.

Many changes may be made in details of the instant invention, in the method and material of fabrication, in the configuration and assemblage of the constituent elements, without departing from the spirit and scope of the appended claims, which changes are intended to be embraced therewithin.

Having thus described the invention, which is claimed as new and useful and desired to be secured by the United States Letters Patent:

1. An inflatable flying saucer toy comprising:

a saucer like body having a peripheral lip, said lip depending from and positioned substantially below said body, said body and lip being joined and forming a single cavity the outer surfaces of which define the toy when inflated, a neck member sealedly attached to said body and open to said cavity and a stopper member for inserting into said neck for forming a pressure seal therewith, said flying saucer toy having sufficient rigidity when inflated for use as a toss toy and sufficiently limp when deflated for its complete deformation for storing in a small area.

2. The invention as defined in claim 1, wherein the walls of the body member defining the cavity are substantially parallel.

3. The invention as defined in claim 1, wherein said depending lip is substantially circular in cross-section.

4. The invention as defined in claim 1, wherein said inflatable flying saucer toy is constructed of pliable gas tight material.

5. The invention as defined in claim 1, wherein said neck member is attached to the under surface of said body member.

6. The invention as defined in claim 1, wherein said neck member is attached to the center under surface of said body member.

7. The invention as defined in claim 1, wherein said stopper means has a frusto-conic cross-section and has a retaining means attached to said neck.

8. The invention as defined in claim 5, wherein said neck member is positioned on the surface of said depending lip adjacent the inner surface of said body member.

* * * * *